United States Patent [19]

Moreno

[11] Patent Number: 4,858,876

[45] Date of Patent: Aug. 22, 1989

[54] POST SUPPORT

[76] Inventor: Albert M. Moreno, One Moren Pl., East Flat Rock, N.C. 28726

[21] Appl. No.: 187,439

[22] Filed: Apr. 28, 1988

Related U.S. Application Data

[63] Continuation-in-part of Ser. No. 43,037, Apr. 27, 1987, abandoned, which is a continuation-in-part of Ser. No. 859,655, May 5, 1986, abandoned.

[51] Int. Cl.[4] ..... F16M 13/00

[52] U.S. Cl. ..... 248/545; 248/530; 248/548; 248/900; 248/156

[58] Field of Search ..... 248/545, 548, 551, 530, 248/156, DIG. 9, 508, 87, 85, 900; 52/155, 157, 165, 98; 40/607, 608, 612; 403/2

[56] References Cited

U.S. PATENT DOCUMENTS

| | | | |
|---|---|---|---|
| 1,335,302 | 3/1920 | Stout | 248/548 X |
| 3,011,598 | 12/1961 | Galloway et al. | 52/157 X |
| 3,349,531 | 10/1967 | Watson | 403/2 X |
| 3,355,998 | 12/1967 | Roemisch | 403/2 |
| 3,521,413 | 7/1970 | Scott et al. | 248/548 X |
| 3,912,404 | 10/1975 | Kah | 403/2 |
| 4,603,520 | 8/1986 | Deike | 52/157 X |

*Primary Examiner*—Ramon S. Britts
*Assistant Examiner*—Karen J. Chotkowski
*Attorney, Agent, or Firm*—Bailey & Hardaway

[57] ABSTRACT

A post and ground support is illustrated utilizing a helical member forming an auger for digging the ground support into the earth, and easily removing the ground support from the ground and reusing said support in another location. The ground support includes a ground engaging stabilizing member affording resistance to a force having a component at right angles to the post, and a breakaway connection is provided between the ground support member and the post, together with a connection for retaining the post in a position near the ground after separation therefrom. The breakaway connection positions the post upon the ground support above the ground and separates in response to a force coming from any direction about the post. A shear pin having longitudinally flat surfaces extending circumferentially thereabout prevents turning of the post with respect to the ground support and a groove extending about said flat surfaces assure uniformity of shearing from any direction in which the force is applied.

16 Claims, 7 Drawing Sheets

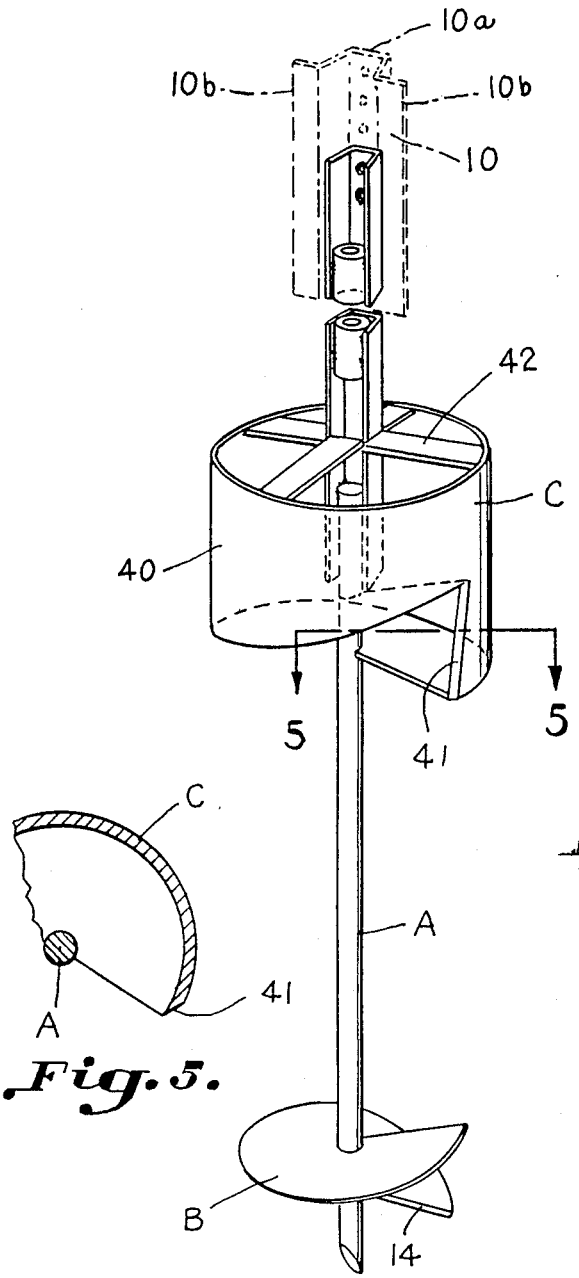
Fig. 5.
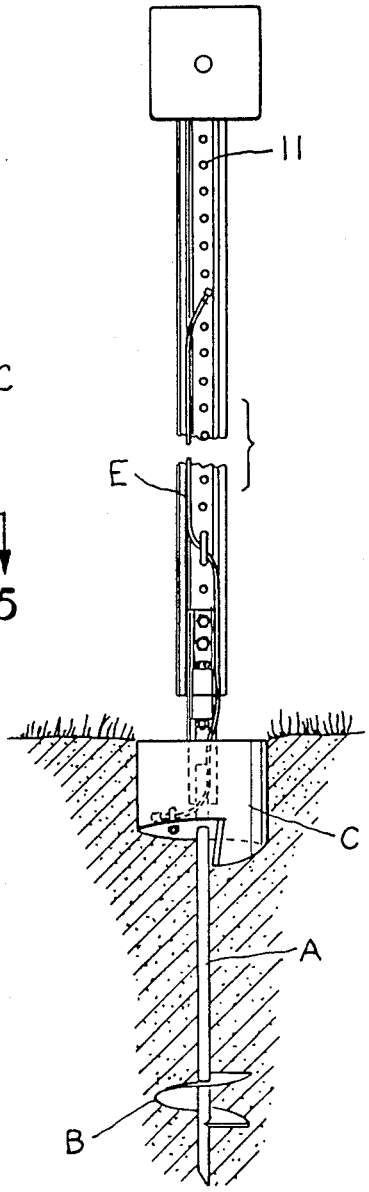
Fig. 4.
Fig. 6.

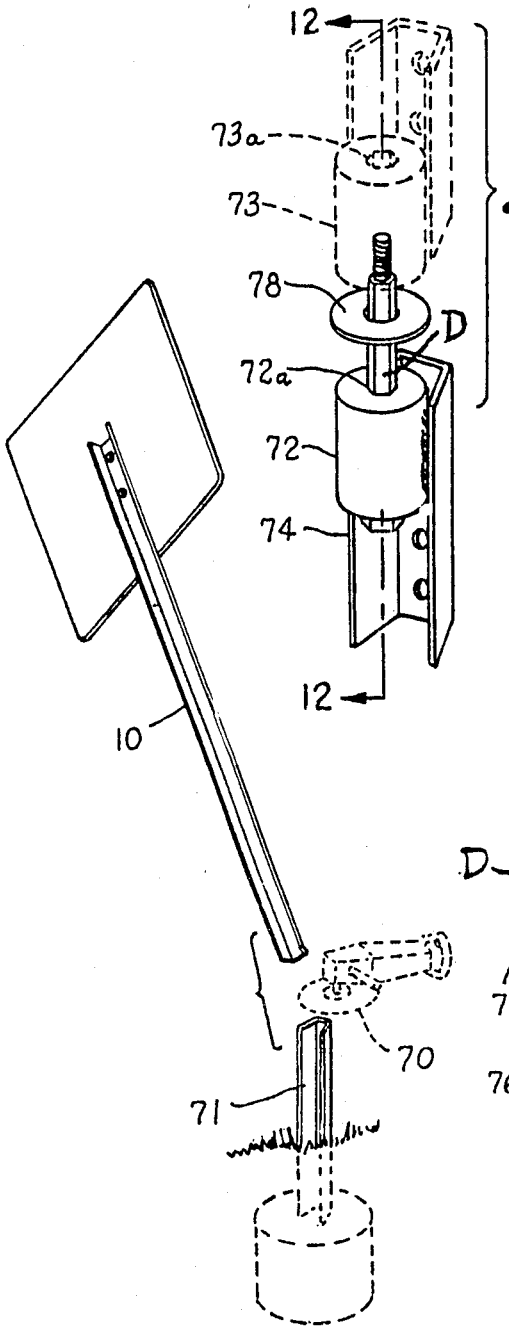
Fig. 11.
Fig. 10.
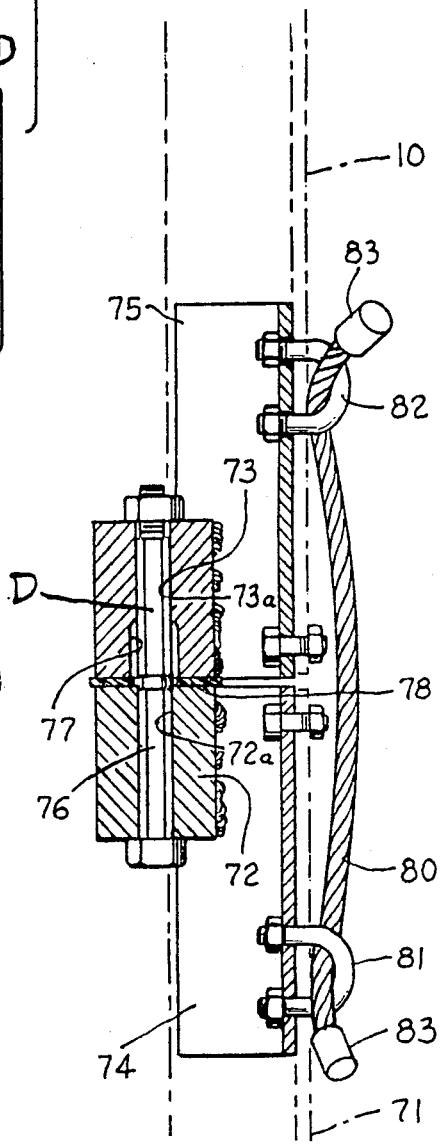
Fig. 12.

Fig. 15.
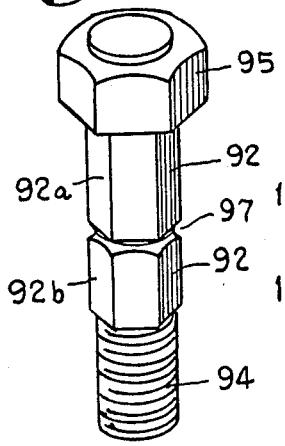
Fig. 16.
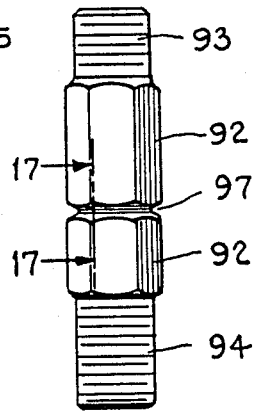
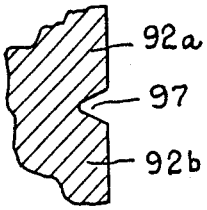
Fig. 17.
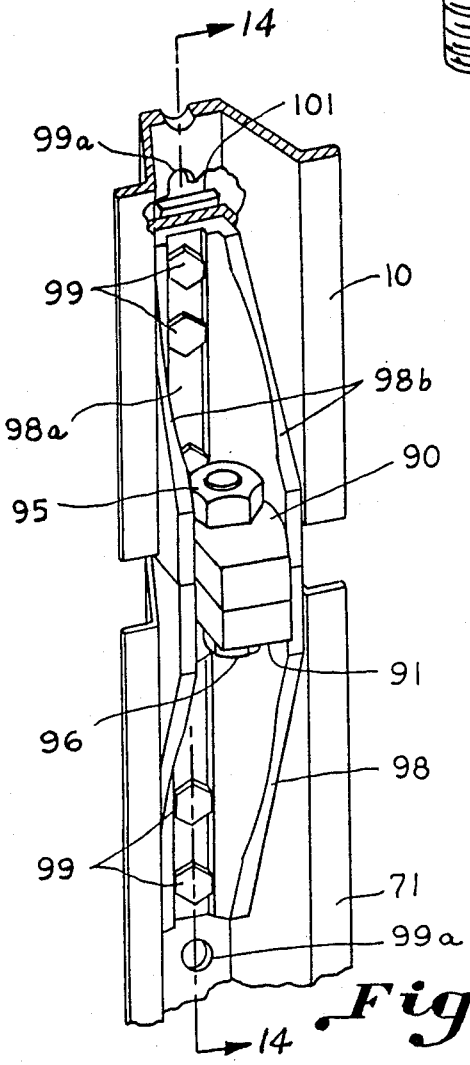
Fig. 13.
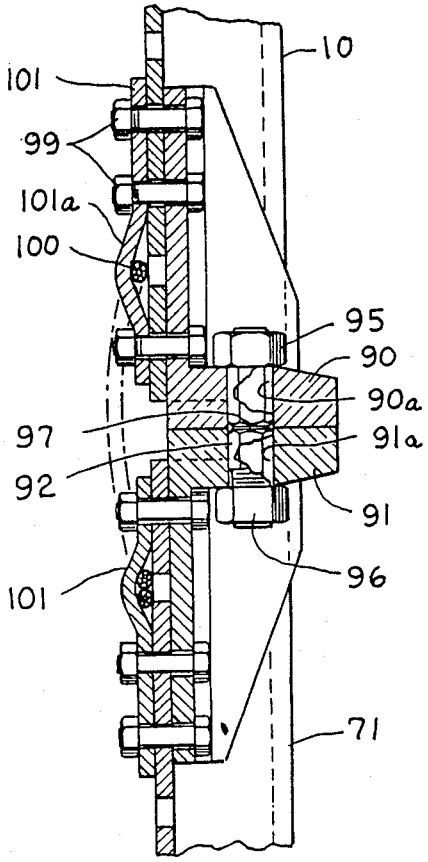
Fig. 14.

POST SUPPORT

This application is a continuation-in-part of Moreno Ser. No. 07/043,037 filed Apr. 27, 1987, which is a continuation-in-part of Ser. No. 06/859,655 filed May 5, 1986 now abandoned.

BACKGROUND OF THE INVENTION

Ground supported posts, such as those carrying highway signs and reflectors, have been provided with breakaway members such as illustrated in U.S. Pat. Nos. 3,820,906 and 4,126,403. Such breakaway structures provide for a separation of the post from a base support when being struck in either of two directions, front or back. An angular blow causes damage to the post which becomes twisted or bent. U.S. Pat. No. 3,355,998 discloses a shank which is threaded on both ends with a groove therebetween for facilitating separation together with an intermediate ring for assuring proper positioning of the groove. The posts upon separation from the bases are often separated over distances as may result in the posts becoming lost or stolen.

For further example, highway posts are often embedded in the earth by utilizing a concrete base anchor for retaining the post support within the earth. Such constructions are expensive, for large holes must be dug and filled with concrete before setting the post therein.

Posts of the type utilized on the highway are often damaged because the portion extending out of the ground is often struck at bumper height to cause the post to be bent over or otherwise damaged so that its usefulness is impaired necessitating replacement at substantial expense.

Accordingly, it is an important object of this invention to provide an improved post support structure which is illustrated herein in the form of a highway post having the familiar U-shaped flanged configuration although other posts may be advantageously constructed in accordance with the invention.

Another important object of this invention is the provision of a ground support for a post which may be readily embedded in the earth through the use of a helical member forming an auger and wherein a ground engaging member is provided for stabilizing the post against a force as may be exerted by the bumper of a vehicle.

Another important object of the invention is the provision of a breakaway construction of simplified construction for connecting a post with a ground support member which may be broken away or sheared off by a force coming from any direction 360° thereabout.

Another important object of the invention is the provision of a connecting apparatus for securing the post to a ground support member from which it may be separated in such a way that suitable slack is provided to permit the post to engage or even lie flat upon the earth but retain same close enough to the support to prevent loss or pilferage.

Still another important object of the invention is the provision of a shear pin having a plurality of flat surfaces to prevent turning of an upper section with respect to a lower or base section having a groove to assure uniformity of shearing action responsive to a force applied in any direction between the post sections.

SUMMARY OF THE INVENTION

It has been found that a post and ground support may be provided utilizing a rod carrying a helical member forming an auger. Ground engaging stabilizing means are provided by a suitable ground engaging member above the helix and carried upon the rod. Preferably this may be a finned member or a collar having a vertical surface for engaging the earth for resisting a force having a right angle component. A breakaway member is provided for separating the post from the ground support without substantial injury to the post in response to a force exerted as a bumper height at any angle around the post. The breakaway member has a pair of opposed abutments having vertical aligned base members thereon when the abutments are placed in back to back relation for retaining a shank member which may be sheared away between the opposed abutments between the opposed base member. A cable connects the post to the ground support having suitable slack to retain the post when the breakaway member has been fractured so as to separate the post from the ground support.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 4 is a perspective view illustrating a modified form of the invention utilizing a fixed collar or circumferential wall acting as a ground engaging stabilizing member;

FIG. 5 is an enlarged sectional plan view taken on the line 5—5 in FIG. 4;

FIG. 6 is a side elevation illustrating a post support constructed in accordance with the invention having a stabilizing member of FIGS. 4 and 5;

FIG. 10 is a perspective view illustrating a modified form of the invention wherein a highway sign such as may have been damaged is cut away near the earth preparatory to adding a breakaway member constructed in accordance with the present invention for repositioning a sign;

FIG. 11 is a perspective view illustrating a breakaway assembly constructed in accordance with a modified form of the invention;

FIG. 12 is a longitudinal sectional elevation taken on the line 12—12 in FIG. 11;

FIG. 13 is a perspective view illustrating a modified form of the invention;

FIG. 14 is a sectional elevation taken on the line 14—14 in FIG. 13;

FIG. 15 is a perspective view illustrating a shear pin constructed in accordance with a modified form of the invention;

FIG. 16 is a side elevation further illustrating the shear pin; and

FIG. 17 is an enlarged sectional elevation taken on the line 17—17 in FIG. 16.

DESCRIPTION OF A PREFERRED EMBODIMENT

The drawings illustrate a post and ground support therefor. The ground support includes an elongated rod A. A helical member B is carried at one end of the rod forming an auger. A ground engaging stabilizing member C is carried by the elongated rod above the helical member affording resistance to a force having a component at right angles to the rod when embedded in the ground. Suitable means connect the post to the rod above said stabilizing member. Such may be an integral connection or breakaway means including an elongated shearable shank D which may be provided for separating the post from the ground support. A cable E having connection on one end to the ground support and on the other end to the post provide a slack portion connecting the post to the ground support when separated therefrom responsive to a force upon the post.

Figure 2:
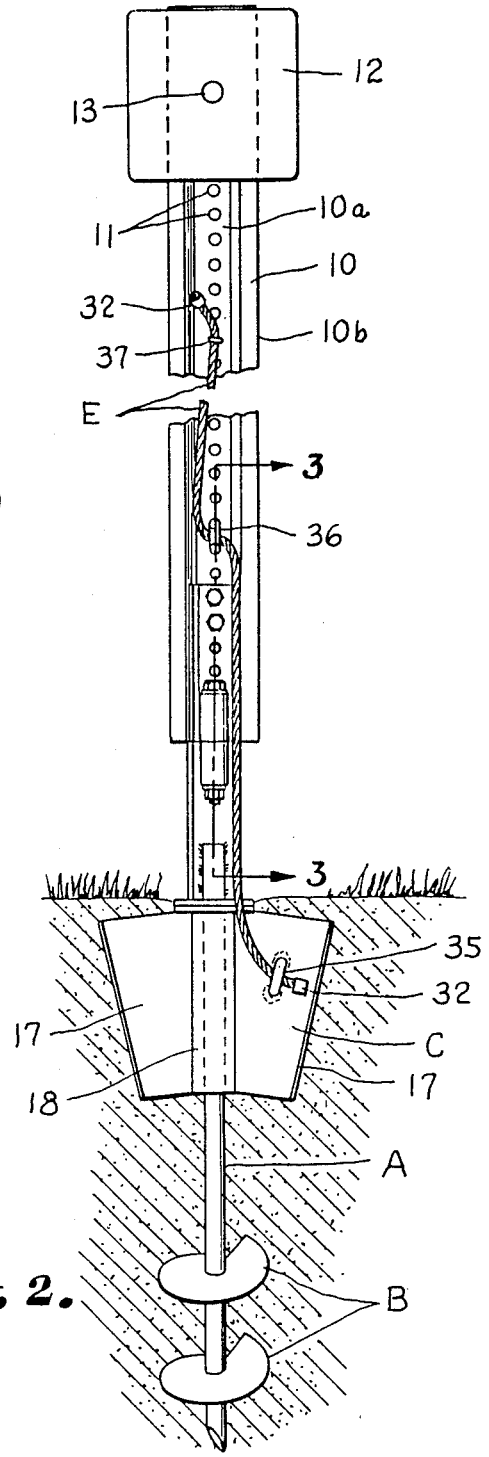
FIG. 2 is a front elevation illustrating the post support of FIG. 1 installed in the earth.

The post illustrated in the drawings is of the type commonly seen on highways, although any other type of post may be advantageously used. The post 10 includes a channelshaped portion 10*a*, together with diverging flanges 10*b*. The channel-shaped portion has a number of vertically spaced holes 11. A reflector member at 12 is suitably secured as by a screw 13 adjacent the top of the post as illustrated in FIG. 2. The auger B includes helical members having a beveled forward edge 14 for entering the earth much like a saw tooth. The helical members together with the bar member A forms an auger for digging into the earth when the bar A is rotated.

Figure 1:
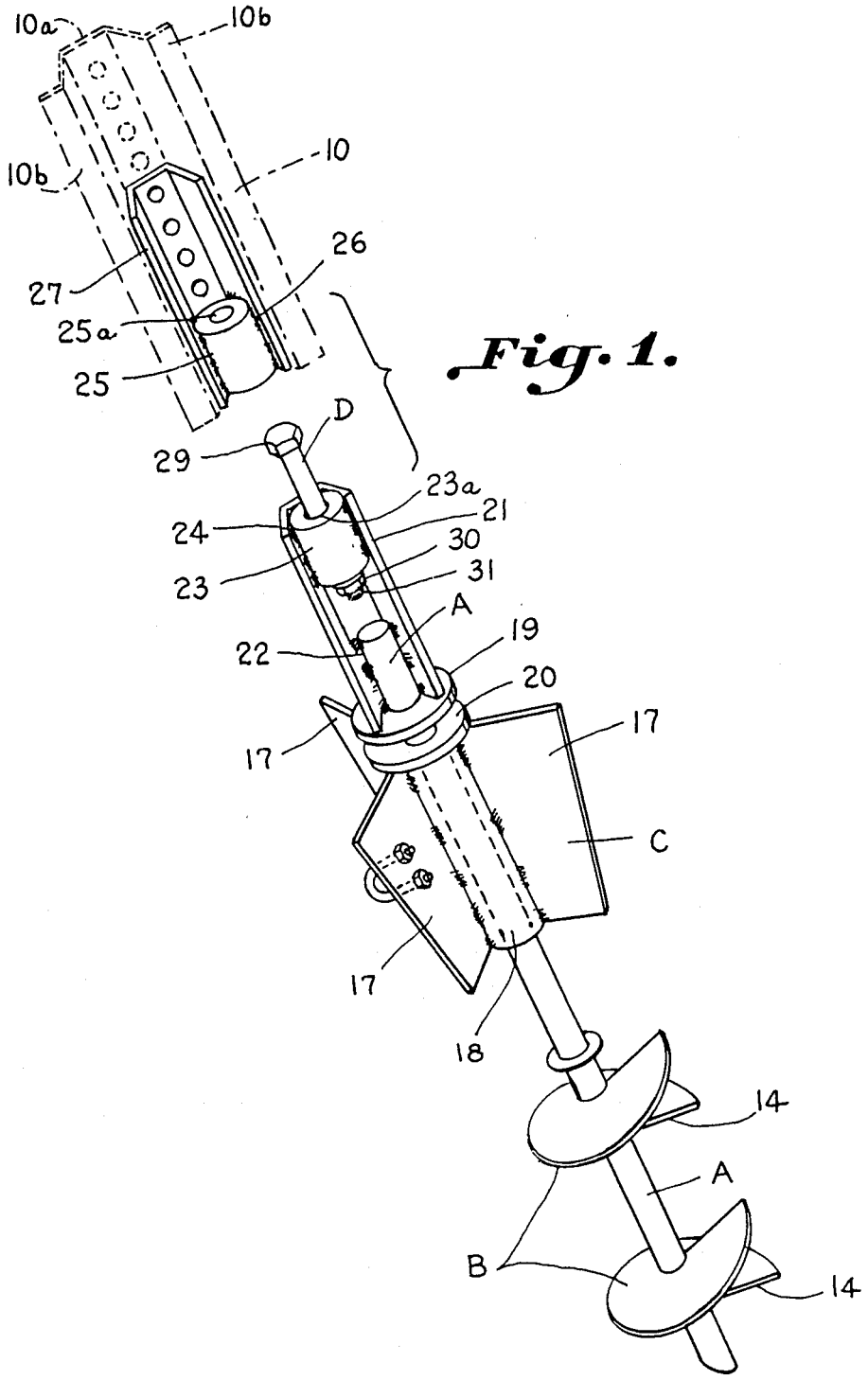
FIG. 1 is a perspective view illustrating a post support constructed in accordance with the present invention having an auger and a vertical slideable finned ground engaging member carried on a rod above the auger portion providing a member extending above the earth to accommodate the breakaway member which includes an elongated shank.
Figure 3:
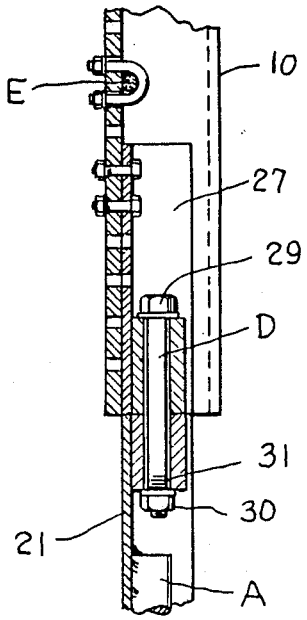
FIG. 3 is an enlarged transverse sectional elevation taken on the line 3—3 in FIG. 2.

The stabilizing member C may assume the configuration illustrated in FIGS. 1 and 2 wherein circumferentially spaced fins 17 provide a vertical portion for bearing against the earth to oppose a force at right angles tending to dislodge the sign. The fins 17 are carried by a collar 18 which is slideably mounted upon an immediate portion of the rod A above the auger portion. The rod A extends above the stabilizer and carries a disk 19 fixed thereon to oppose a disk 20 carried adjacent the top of the slideable or floating stabilizing member C.

The rod A carries a channel-shaped member 21 fixed to the rod A as by welding as at 22. An abutment member 23 is generally cylindrical an is fixed as by welding 24 adjacent an upper end of the channel member 21. A second opposed abutment 25 is fixed as by welding 26 to a channeled portion 27 for securement within the bottom of the post. The cylindrical members 23 and 25 have respective vertical bores 23*a* and 25*a* which are in alignment to carry the shank member D. The shank D carries enlarged bearing members 29 and 30 for bearing on opposite ends of the abutments 25 and 23 respectively. The bearing member 29 is integral whereas the lower bearing member 30 may be threadably carried as at 31 upon an end of the shank, for easy positioning and assembly.

Figure 7:
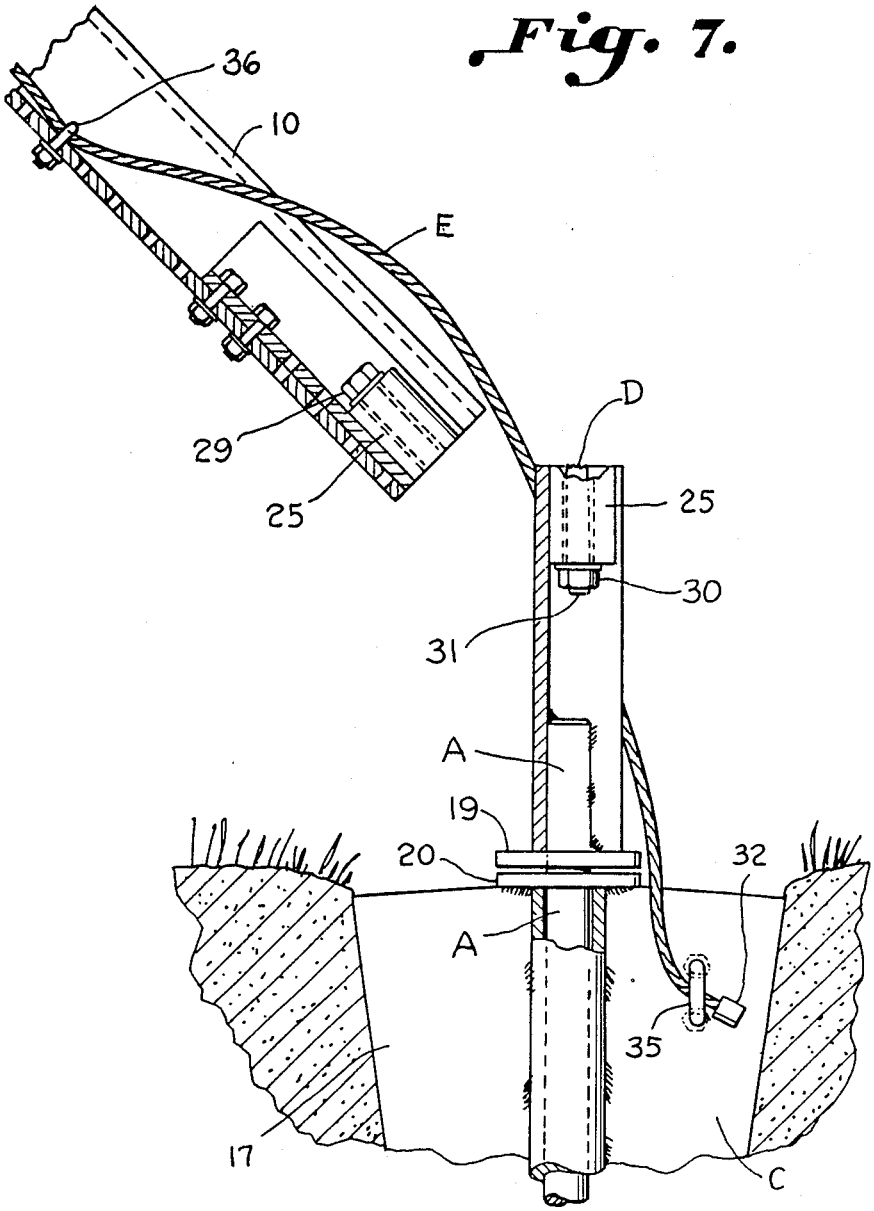
FIG. 7 is a front elevation illustrating a post and ground support wherein the breakaway member includes a sheared shank or pin member, and wherein a cable is provided for maintaining a connection between the post and the ground support.

A cable E is provided which has enlarged bearing member 32 adjacent each end. The cable provides sufficient slack to permit the post to be sheared away from the base support as illustrated in FIG. 7 by preventing same from becoming dislodged or thrown into the road as may impede vehicles or become so far removed as to be lost or stolen. The cable E extends through a pair of U bolts 35 and 36, and an upper part thereof, which constitutes slack, may be secured as through the use of a cotter pin 37 and the like to lie flat within the channel portion of the post. The U bolt 36 serves as a hold-down member to engage the bearing member 32 for forming the connection when the post is separated from the support.

A modified form of vertical stabilizer is illustrated in FIGS. 4 through 6 which includes a circumferential wall 40 which carries a beveled cutting edge 41 which incline outwardly from top to bottom as illustrated in FIG. 4 to facilitate cutting as in a saw tooth. The beveled or chamfered edge 41 pushes the earth outwardly so that a firm bearing is achieved between wall 40 and undisturbed earth. The upper portion of circumferential member 40 is braced as at 42 and connected to an upper portion of the ground support portion. Such a construction has the advantage of inhibiting the growth of grass from being mowed around the post. In each embodiment of the stabilizing member illustrated a wall portion extends beyond the helical members of the auger portion to as to bear upon undisturbed earth.

Figure 8:
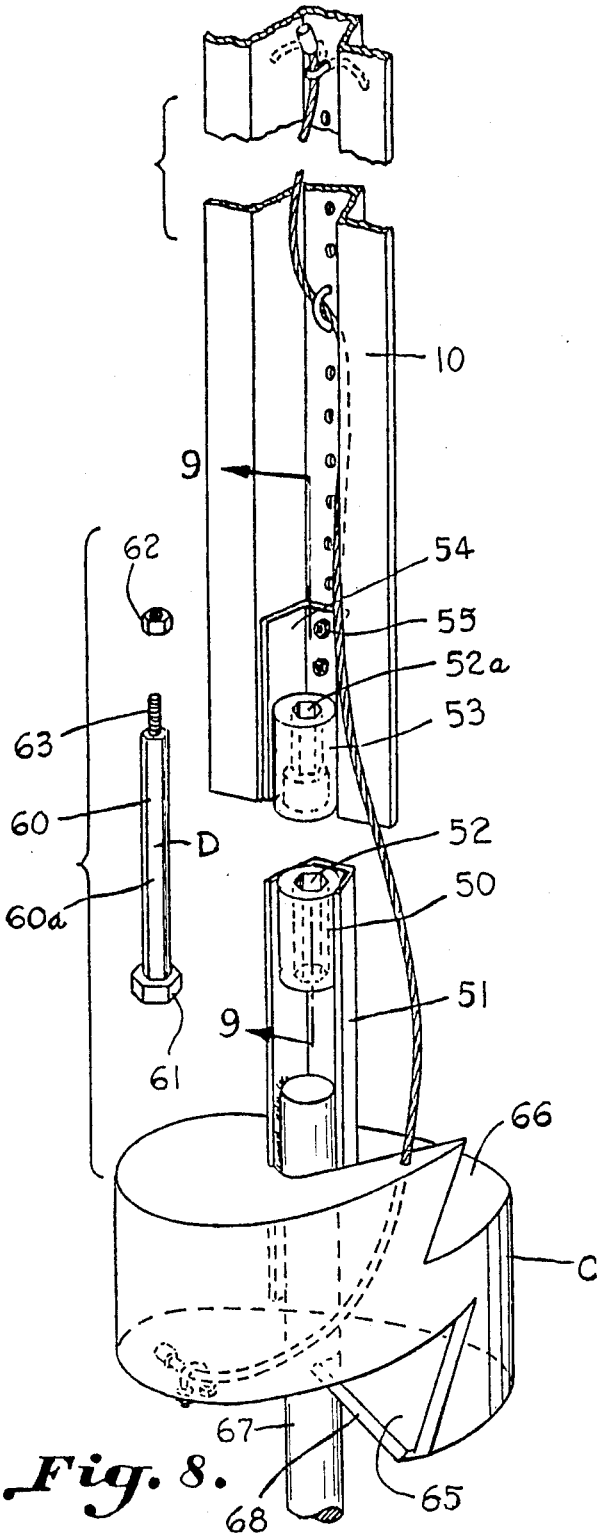
FIG. 8 is a perspective view illustrating a modified form of the invention wherein a helix is provided at the top of the auger member permitting entry into the earth for an unlimited distance.
Figure 9:
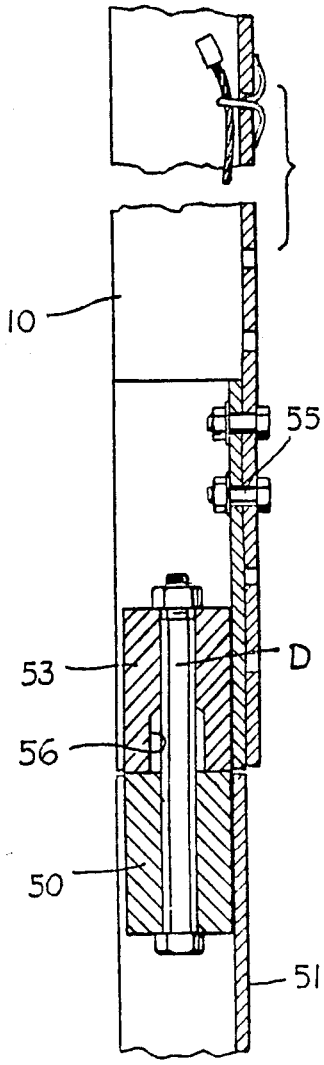
FIG. 9 is a longitudinal sectional elevation taken on the line 9—9 through the opposed abutments.

FIGS. 8 and 9 illustrate a modified form of the invention wherein a modified form of the breakaway device is illustrated. A first abutment 50 is illustrated as being positioned upon a lower post section 51. The first abutment has a hexagonal opening 52 axially positioned in alignment with the post section 51 and suitably formed there as by broaching. A second abutment 53 is illustrated as being positioned upon a lower portion of upper post section 10 utilizing bracket member 54 upon which the abutment 53 is welded. The abutment 50 is illustrated as being welded directly to the lower post section 51. Openings are provided in the bracket 54 which are secured as by bolts 55 through corresponding openings in the post 10. It will be observed that a recess or opening is provided adjacent abutting surfaces of the abutments 50 and 53 and illustrated in the abutment 53 as at 56. This recess permits lateral movement of the upper post section to initiate a shearing action at the opposed portions of the abutments 50 and 53. A hexagonal shank member is illustrated at 60, and a head is illustrated at 61 integral with the shank but which may if desired be suitably threaded thereon. A nut 62 constitutes a bearing member opposite the bearing member 61 which is received upon a threaded portion 63 of the shank. It will be observed that the hex shank has a plurality of flats 60*a* circumferentially carried thereabout to engage the flats of the hexagonal openings 52 and 52*a* formed axially in the abutments 50 and 53 respectively.

Referring more particularly to FIG. 8, an auger is illustrated as including a first helical member 65 positioned in the lower portion of the wall C. A complementary upper helix is illustrated at 66 as being secured to the ground support rod 67. The helical surfaces have beveled edges such as illustrated at 68. The helical member 66 has similar cutting surfaces and permits the auger portion carrying the wall C to be lowered beneath the surface of the earth at any desired depth.

FIG. 10 is a perspective view illustrating a modified form of the invention wherein the upper sign portion 10 is being removed from a conventional sign as by sawing with the circular saw illustrated at 70 carried in the earth in any desirable way. A breakaway assembly constructed in accordance with a modified form of the invention is to be inserted for supporting the sign upon the remaining base portion 71.

FIG. 11 illustrates a first abutment 72 positioned upon the lower post section 70 while a second abutment 73 is illustrated upon an upper portion of the sign 10 as also illustrated in FIG. 12. The bracket members 74 and 75 position the abutments 72 and 73 respectively upon the respective post sections of the sign. A hexagonal shank is illustrated at 76 to be received within respective hexagonal openings **72*a* and 73*a* in the respective abutments 72 and 73. An enlarged portion or recess 77 is illustrated in a lower portion of the upper abutments 73, and a doughnut shaped thin sheet of smooth or slick plastic 78 is illustrated as being positioned between abutting surfaces of the abutments 72 and 73. The plastic sheet is preferably formed of polyvinyl cloride approximately 20 thousandths of an inch thick. The flexible cable is illustrated at 80 secured as by U bolts 81 and 82 to the post sections. Means securing the cable at its ends include cable stop members 83**, illustrated at each end of the cable.

It has been found that the breakaway assembly is effective in resisting wind loads and any tendency to oscillate because of the multifaceted construction of the shank of the shear pin and yet is capable of shearing away at relatively low impact loads to avoid damage to vehicle and sign post. The apparatus promotes safety for occupants of a vehicle because shearing with breakaway occurs at low speeds with minimal slow down of the vehicle. Moreover, at high speeds breakaway also occurs with minimal slow down and without appreciable change in the direction of travel of the vehicle.

A shear pin and associated parts constructed in accordance with a modified form of the invention are illustrated in FIGS. 13–17 for use in a breakaway connection between a lower post section or base portion 71 fixed on one end and an upper post section or sign portion 10. The breakaway connection has opposed abutments 90 and 91 receiving a shearing force therebetween carried at adjacent opposed ends of the post sections with axially aligned pin receiving openings **90*a* and 91*a* therein conforming to an intermediate portion of the pin resisting forces tending to twist said upper post section upon said lower post section. A plurality of longitudinally aligned flat surfaces 92 extend circumferentially about an intermediate portion of the pin. Fastening means 93 and 94 are carried at each end of said pin for securing bearing members 95 and 96 thereto. At least one of the fastening means at one end of the pin has threads to receive one of the bearing members while the other bearing member may be integral with the pin thereon. A circumferential groove 97 is provided in the intermediate portion of the pin. The groove extends into the flat surfaces forming an arcuate connecting portion of reduced cross section separating the pin into upper and lower sections 92*a* and 92*b***. Thus, the groove permits a substantially uniform shearing action at the connecting portion regardless of where a shearing force may be applied about said pin.

The fastening means each are threaded and are circular in cross section for receiving a bearing member in the form of a nut. The connecting portion is circular in cross section and the intermediate portion containing the flats is hexagonal in cross section.

The abutments 90 and 91 are integral with bracket members 98. The bracket members and the abutments may be of cast or other suitable construction and are secured by bolts 99 which pass through the openings **99*a* in the post sections. The brackets 99 are provided with web members 98*a* between the flanges 98*b*. A cable 100, provided for connecting the post sections after shearing of the pin, has sufficient length to permit the upper section to rest with its entire length upon the ground after shearing of the pin. The ends of the cable are retained by suitable substantially rectangular elongated backup plates 101. A raised portion of the plates 101*a* confine respective ends of the cable 100 therebeneath. The backup plates also perform an additional function in strengthening and lending rigidity to the post near the bracket and abutment supporting end portions thereof. The additional stiffness, rigidity and strength imparted to the upper and lower post sections is provided the entire assembly and is secured together by bolts 99 which pass through the bracket portion of the castings 98**, the web portion of the post as well as the backup plates.

While a preferred embodiment of the invention has been described using such specific terms, such description is for illustrative purposes only, and it is to be understood that changes and variations may be made without departing from the spirit or scope of the following claims.

What is claimed is:

1. A shear pin for use in a breakaway connection between a lower post section fixed on one end and an upper post section, said breakaway connection having opposed abutments receiving a shearing force therebetween carried at adjacent opposed ends of said section with axially aligned pin receiving openings therein conforming to an intermediate portion of said pin resisting forces tending to twist said upper post section upon said lower post section comprising:

a plurality of longitudinally aligned flat surfaces extending circumferentially about an intermediate portion of said pin;

fastening means at each end of said pin for securing a bearing member thereto;

at least one of said fastening means at one end of said pin having threads to receive a bearing member thereon;

a circumferential groove in said intermediate portion of said pin;

said groove extending into said flat surfaces forming an arcuate connecting portion of reduced cross section separating said pin into upper and lower sections;

whereby said groove permits a substantially uniform shearing action at said connecting portion regardless of where a shearing force may be applied about said pin.

2. The structure set forth in claim 1 wherein said fastening means each are threaded and are circular in cross section.

3. The structure set forth in claim 2 wherein said connecting portion is circular in cross section and said intermediate portion is hexagonal in cross section.

4. A shear pin for use in a breakaway connection between a lower post section fixed on one end and an upper post section, said breakaway connection having opposed abutments receiving a shearing force therebetween carried at adjacent opposed ends of said sections with axially aligned pin receiving openings therein conforming to an intermediate portion of said pin resisting forces tending to twist said upper post section upon said lower post section comprising:

a plurality of longitudinally aligned flat surfaces extending circumferentially about an intermediate portion of said pin;

fastening means adjacent each end of said pin for positioning said pin;

at least one of said fastening means at one end of said pin having threads;

a circumferential groove in said intermediate portion of said pin;

said groove forming a connecting portion of reduced cross section separating said pin into upper and lower sections;

whereby said groove permits a substantially uniform shearing action at said connecting portion regardless of where a shearing force may be applied about said pin.

5. The structure set forth in claim 4 wherein said connecting portion is defined by an arcuate groove.

6. The structure set forth in claim 5 wherein said axially aligned openings have longitudinally aligned flat surfaces extending circumferentially thereabout corresponding to said flat surfaces on said pin.

7. The structure set forth in claim 4 including a bracket member integral with each of said abutments for securing the abutments to respective post sections.

8. The structure set forth in claim 7 including a backup plate on a back side of said post sections opposite said bracket members.

9. The structure set forth in claim 8 including a connecting cable secured beneath said back up plates on respective ends to said upper and lower section.

10. A breakaway device for mounting an upright upper post section upon an upright lower post section supported within the earth comprising;

a first abutment positionable upon said lower post section at an upper end thereof having an opening therein in alignment with said lower post section;

a second abutment positionable upon said upper post section at a lower end thereof having an opening therein in alignment with said upper post section and with said opening in said first abutment;

said upper and lower surfaces carried by said first and second abutments respectively positioned in opposed relation;

a bearing surface remote from respective upper and lower surfaces carried by said first and second abutments;

a threadied shack member positined in said openings;

a plurality of longitudinal flats positioned circumferentially about said shank member; and bearing members positioned in bearing relation with respective bearing surfaces and carried adjacent each end of said shank;

whereby said shank acts as a shear pin joining said upper post section with said lower post section which may be broken away in response to a force having a right angled component applied to said upper post section from any direction thereabout.

11. The structure set forth in claim 10 including a flexible cable having connection with said first abutment on one end and with said second abutment on the other end.

12. The structure set forth in claim 11 including a recess in at least one of said abutments opposite the other abutment at opposed surface thereof.

13. The structure set forth in claim 12 including respective first and second brackets carrying said first and second abutments, and attachment means for securing ends of said cable to said bracket means.

14. The structure set forth in claim 13 including a sheet of smooth plastic between opposed surfaces of said abutments.

15. For use in a breakaway device for mounting an upright upper post section upon an upright lower post section supported within the earth having upper and lower abutments carried by resepctive upper and lower post sections having abbutting surfaces in opposed relation, a shear pin for adjoining said abutments comprising: an elongated shank extending longitudinally through said abutments;

a plurality of longitudinal flats carried circumferentially about said shank for engaging said abutments against turning about a longitudinal axis;

threads carried by said shank on at least one end thereof receiving a bearing member thereon in bearing relation upon a surface of one of said abutments remote from said abutting surfaces; and the other end of said shank engaging the other of said abutments.

16. The structure set forth in claim 15 wherein a bearing member is integral with the other end of said shank.

* * * * *